US005331695A

United States Patent [19]

Bales

[11] Patent Number: 5,331,695

[45] Date of Patent: Jul. 26, 1994

[54] PIVOT BEARING FOR WOOD FRAME WALL BED SYSTEMS

[76] Inventor: Roger Bales, 33 Vista View, South San Francisco, Calif. 94080

[21] Appl. No.: 40,134

[22] Filed: Mar. 30, 1993

[51] Int. Cl.[5] ..... A47C 17/38; A47C 17/40; A47C 17/46; E05d 5/12

[52] U.S. Cl. ..... 5/136; 16/273; 16/380; 16/386; 403/68; 403/69; 403/71

[58] Field of Search ..... 5/136, 159.1, 164.1, 5/166.1, 282.1, 279.1; 403/68, 69, 71, 161; 16/380, 386, 273

[56] References Cited

U.S. PATENT DOCUMENTS

| | | | |
|---|---|---|---|
| 778,413 | 12/1904 | Kilmon | 16/386 |
| 3,046,572 | 7/1962 | Eames et al. | 5/136 |
| 3,921,225 | 11/1975 | Suska | 16/273 |

*Primary Examiner*—Alexander Grosz
*Attorney, Agent, or Firm*—David E. Newhouse

[57] ABSTRACT

A three element pivot bearing for wood frame wall bed systems includes a spindle having an anchoring tang at one end perpendicular to its axis and two cylindrical bearing bushings each with an annular collar at one end journaled around the spindle with the annular collars facing each other. One bearing bushing is received in a hole drilled into/through a wood side frame of a mattress pallet for a wall bed with its annular collar facing out. The other beating bushing extends into a hole drilled into-through a wood vertical side support of the wall bed with its annular collar facing in. The spindle extends through either the wood side frame of the mattress pallet or wood vertical side support of the wall bed into the respective beating bushings with its anchoring tang secured to either of the side frame of the mattress pallet or vertical side support. Conical head screws received in countersunk holes drilled through the collars and spindle tang secure the respective bearing elements to the respective wood frame members.

10 Claims, 3 Drawing Sheets

PIVOT BEARING FOR WOOD FRAME WALL BED SYSTEMS

BACKGROUND OF THE INVENTION

Wall bed systems typically include a mattress pallet which moves between a horizontal or sleeping position to a vertical or storage position supported at one end or side by a standing support frame. A swinging support member is typically secured to the bottom of the mattress pallet at its distal end which pivots down to support the extending end or side of the mattress pallet in the sleeping position. Springs, gas charged pneumatic cylinders, weights and the like are typically utilized to counterbalance the weight of the mattress and supporting pallet as the pallet pivots back and forth between the horizontal sleeping and vertical storage positions. With the supporting pallet and mattress positioned in the storage position, wall beds systems typically comprise a relatively compact hexahedral structure approximately 18 to 24 inches deep, standing 80 to 110 inches high against a room wall. And, depending on bed size and associated cabinetry, the width of wall bed systems range from 44 inches to 125 inches. In some cases the standing support frames actually form a part of the framing for a room.

There are diverse types of mechanisms in existing wall bed systems coupling between the standing support frame and the mattress pallet which allow the pallet and mattress to be moved between the vertical storage position and the horizontal sleeping position. In most instances, there is a rotational axis about which the mattress and pallet must effectively rotate in order to move between such horizontal and vertical orientations. Typically, pivoting couplings mounted between the mattress pallet and the vertical support frame define that rotational axis. Ideally such couplings are located at pivot points on the axis of rotation of the wall bed system. Because of the mechanical loading experienced when moving the counterbalanced mattress and supporting pallet between vertical and horizontal positions, such couplings must be relatively robust and able to withstand considerable wear and tear. However, in wood frame wall bed systems the wood to which existing pivoting couplings are fastened is typically not sufficiently robust to withstand wear and tear at the pivot points.

SUMMARY OF THE INVENTION

The invented pivot bearing for wood frame wall bed systems includes a spindle having an anchoring tang at one end perpendicular to its axis and two cylindrical bearing bushings each with an annular collar at one end journaled around the spindle with the annular collars facing each other. The spindle and bearing bushings are preferably composed of a hard, wear resistant structural materials such as steel. One bearing bushing is received in a hole drilled into/through each wood side frame of a mattress pallet of a wall bed system with its annular collar facing out. The other bearing bushing is received in a hole drilled into/through each wood vertical side support of the wall bed system with its annular collar facing in. The spindle extends through either the wood side frame of the mattress pallet or wood vertical side support of the wall bed into the respective bearing bushings with its anchoring tang secured to either of the side frame of the mattress pallet or vertical side support of the wall bed. Conical head screws received through countersunk holes drilled through the annular collars and spindle tang secure the respective bearing bushings and spindle to the respective wood frame members.

The principal advantage of the invented pivot bearing for articulating wood frame members relates to eliminating wear and tear between articulating and stationary wood frame members at the pivot points. In particular, the bearing bushings anchored in the articulating and stationary wood frame members respectively provide a hard inner bearing surface in which the spindle rotates and hard abutting thrust bearing surfaces provided by the annular collars of the bushings.

Another advantage is that a mattress pallet of a wall bed system can be pivoted between horizontal and vertical positions within a standing/vertical frame about an axis defined by two coaxially aligned pivot bearings allowing the weight of the pallet and mattress extending from the standing frame to be counter balanced by weights or a comparable source of force acting at the head of the pallet.

Still other features, aspects, advantages and objects presented and accomplished by the invented pivot bearing for wood frame wall bed systems and similar articulating and rotating systems involving wood flames will become apparent and/or be more fully understood with reference to the following description and detailed drawings of preferred and exemplary embodiments.

DESCRIPTION OF PREFERRED AND EXEMPLARY EMBODIMENTS

Figure 1:
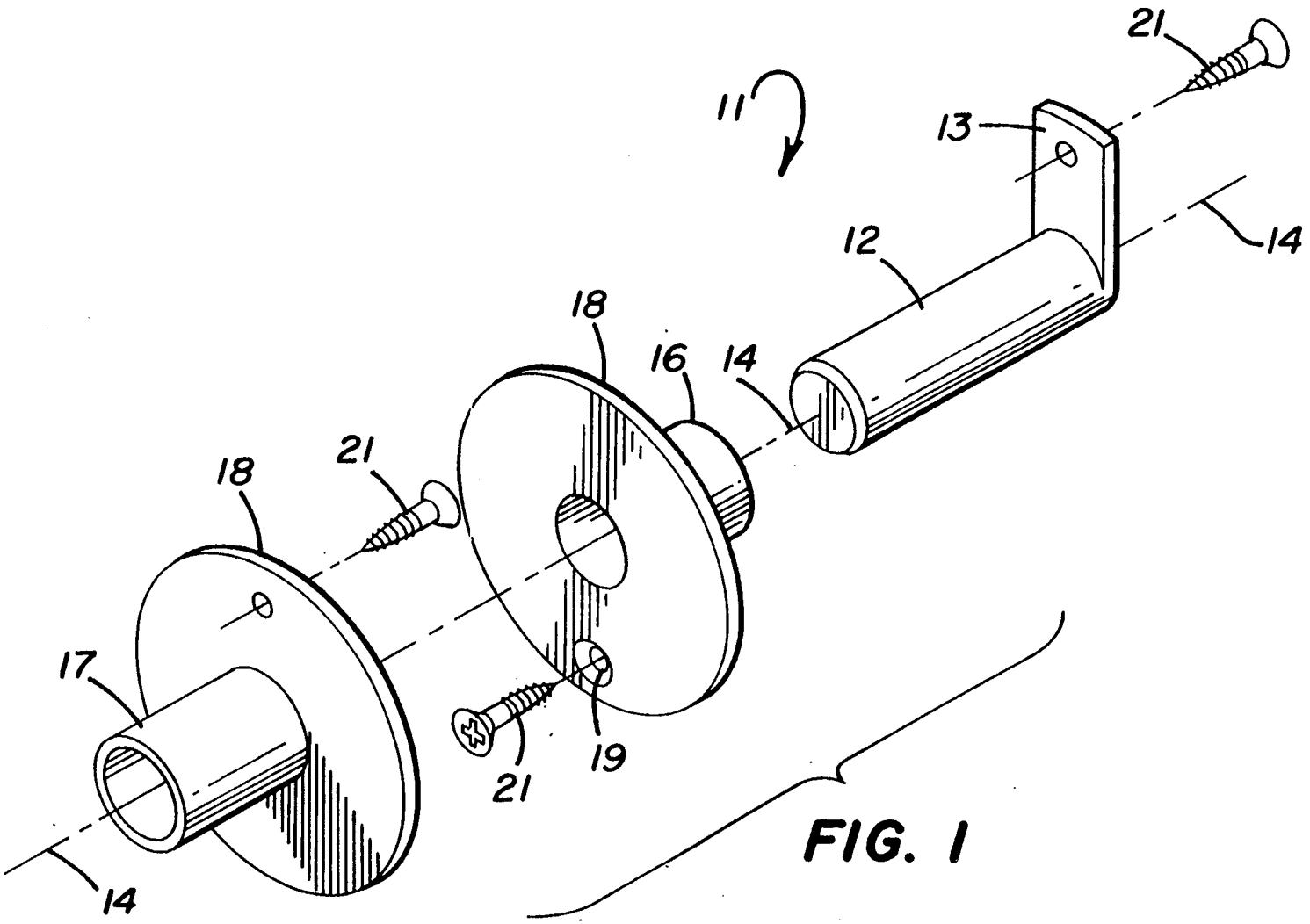
FIG. 1 is an exploded perspective rendering of the three elements of the invented pivot beating for articulating wood frame structures.

With reference to FIG. 1, the invented pivot bearing 11 for articulating wood frame members includes a spindle 12 with an anchoring tang 13 extending perpendicularly relative to its axis 14 and two cylindrical bearing bushings 16 & 17 each having an annular collar 18 at one end adapted to be journaled around the spindle 12 with the annular collars 18 facing each other. Counter sunk anchoring holes 19 are drilled through the respective collars 18 of the bearing bushings 16 & 17 and through the distal end of the anchoring tang 13 of the spindle 12. Conventional conical head wood screws 21 received through the anchoring holes 19 secure the bearing bushings 16 and spindle 12 to an articulating wood frame member (not shown) and the bearing bushing 17 to a stationary wood frame member (not shown).

Figure 2:
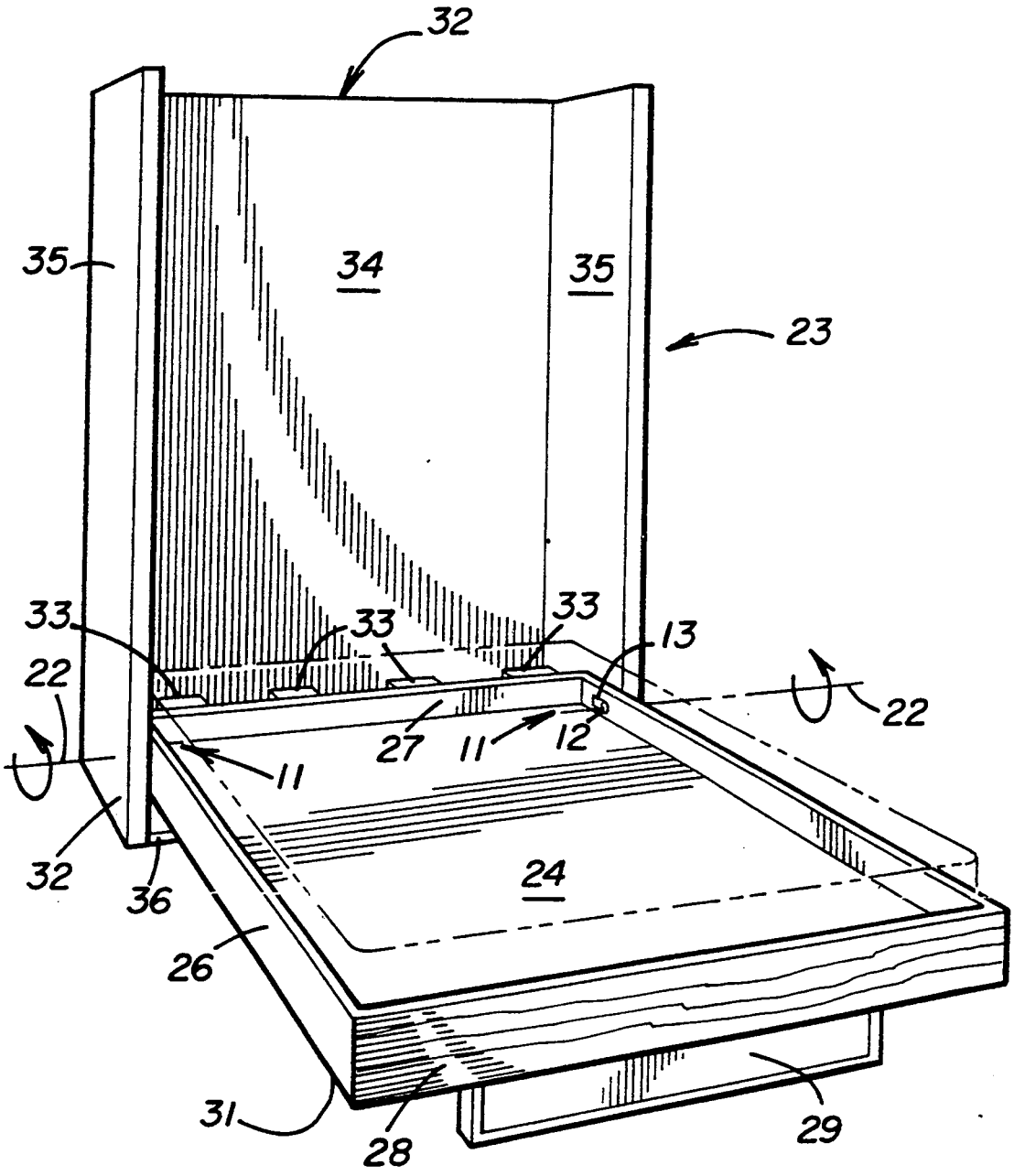
FIG. 2 is a perspective showing the mattress pallet and standing frame of a conventional wall bed system using a pair of the invented pivot bearings.

Looking at FIG. 2, two of the invented pivot beatings 11 are aligned coaxially to provide a pivot axis 22 for a wall bed system 23. As shown, the wall bed system 23 includes a rectangular mattress pallet 24 with parallel side frames members 26, a head frame member 27 and a base frame member 28. A conventional foot support frame 29 is pivotally secured to,the bottom 31 of the mattress pallet 24 to support the extending end of the pallet in the horizontal position. The pair of coaxially aligned pivot bearings 11 couple and support the head of mattress pallet 24 between two sides walls 35 of a stationary standing frame structure. Counterbalancing weights 33 are incorporated into and/or secured to the head frame member 27 of the mattress pallet 24. The pivot axis 22 of the wall bed system 23 is appropriately spaced from the back wall 34 and from the base 36 of the standing frame 32 such that the bottom surface 28 of the mattress pallet 23 completely closes or covers the rectangular openning of the standing frame structure 32 when the mattress pallet 24 is pivoted into the vertical storage position (not shown).

Figure 3:
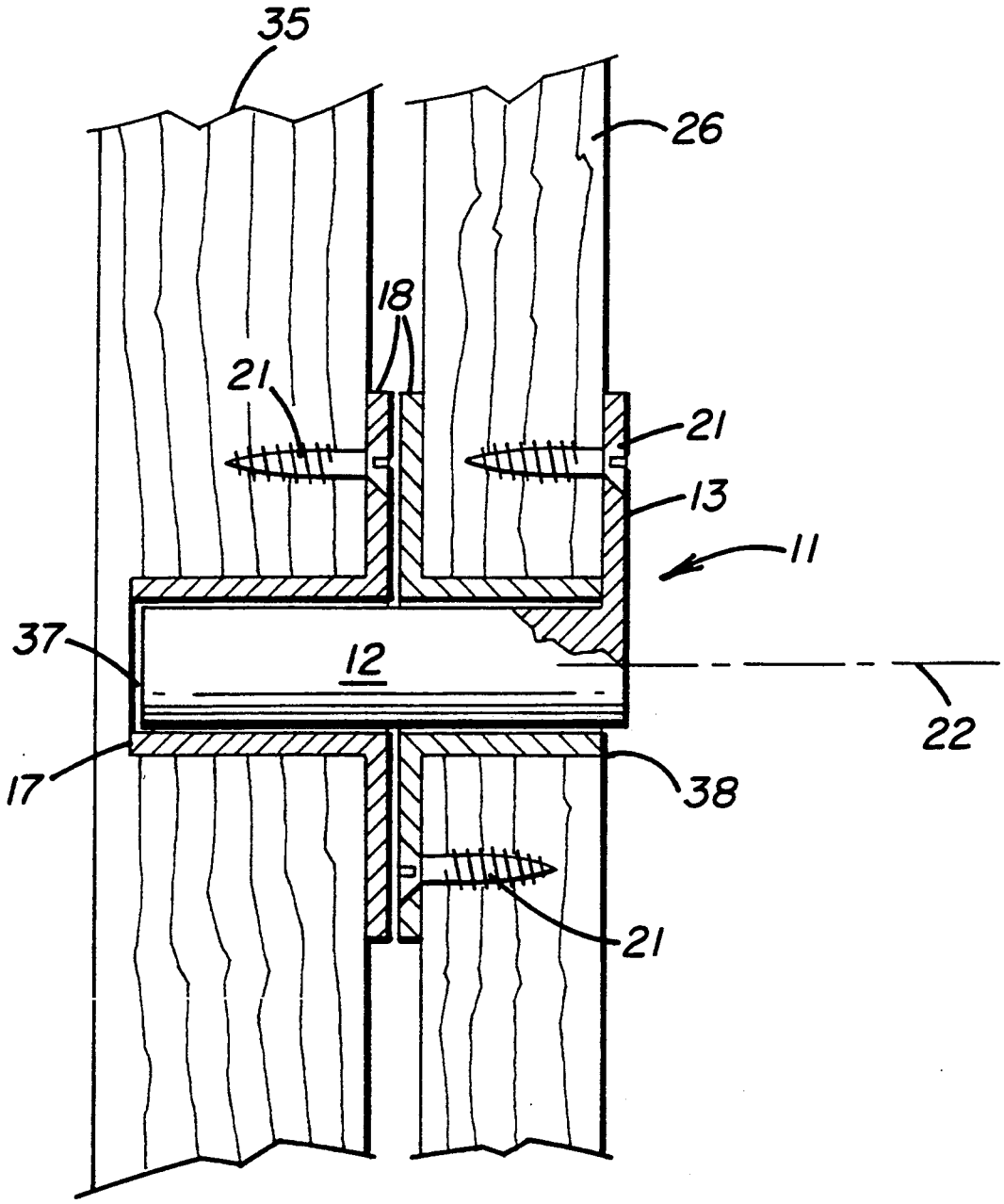
FIG. 3 is a top elevation cross section view of the invented pivot beating incorporated into two relatively rotating wood frame members of a conventional wall bed system.

With reference to the top elevation cross section view of FIG. 3, an invented pivot beating 11 couples the respective side frame member 26 of the mattress pallet 24 to a side wall 35 of the standing frame structure 32. As illustrated, a bearing bushing 17 of the invented pivot beating 11 is received in a hole 37 drilled into the inside surface but not through a side wall 35 of the standing frame structure 32 with its annular collar 18 facing to the inside of the standing frame 32. Beating bushing 16 is received in a hole 38 drilled through the side frame member 26 of the mattress pallet 24 with its annular collar on outside surface of the side frame member. The beating bushings 16 & 17 on the respective sides of the wall bed system are then positioned in coaxial alignment, and spindles 12 are inserted into respective aligned bores of adjacent bearing bushings from the inside the frame of the mattress pallet 24. Conventional conical head wood screws 21 received through the counter sunk holes 19 drilled through the respective tangs 13 and collars 18 secure bearing bushings 17 to side walls 35 of the standing frame 32 and the bearing bushings 16 and spindles 12 to the side frames 26 of the mattress pallet 24. Conventional wood glue may also be used to enhance bonding between the exterior surfaces of bearing bushings 16 & 17 and the particular wood frame member in which it is mounted.

Care should be taken to assure that the heads of the conical head screws 21 received through the counter sunk holes 19 drilled through the facing annular collars of the bearing bushings 16 & 17 securing them to the respective articulating wood members seat below the respective facing surfaces of the collars, other,vise the screw heads will be worn down by the abutting surface of the facing annular collar 18 of the adjacent bearing bushing. Also care should be taken by appropriately rotating the beating bushings 16 & 17 relative to each other, to assure that the rotational positions of the respective screws 21 securing the respective collars 18 of the beating bushing 16 & 17 do not rotationally coincide as the mattress pallet 24 is pivoted 90° between the horizontal sleeping and the vertical storage positions. Finally, the spindle and bearing bushings should be composed of a hard, wear resistant structural materials such as alloys of steel, copper and aluminum.

A Teflon impregnated filament wound epoxy glass liner can be incorporated between the relativly rotating radial beating surfaces of the spindle and the bearing bushing and facing surfaces of collars of the invented pivot bearing to assure an even smoother, wearless pivoting coupling of the relatively articulating wood frame members. Such liners are manufactured by GARLOCK BEARING, INC. of Throfare, N.J. In particular, the Teflon in the liners acts as lubricant between the relatively moving smooth steel bearing surfaces which diminishes both static and rolling friction as load increases.

It is also feasible to utilize a combination of bearing bushings composed of wear resistant plastic polymers such as acetyl homopolymer resins and acetyl copolymer resins which have lubricating properties with a spindle composed of a structural metal.

The invented pivot bearing for wood frame wall bed systems has been described in context of representative and/or preferred embodiments. Many modifications and variations can be made to the invented pivot bearing which while not described herein, fall within the spirit and the scope of invention as described in the appended claims

I claim:

1. In a wood wall bed system including a wood mattress frame comprising a mattress pallet and side frames, said frame coupled to and supported near its head end between wood side walls of a standing frame structure for rotation about a pivot axis between a horizontal sleeping position and a vertical storage position between the walls of the standing frame structure; a pair of improved pivot beatings for coupling the mattress frame and standing frame structure, each comprising, a cylindrical spindle having a tang at one end extending perpendicular to its axis, two cylindrical bearing bushings each having an annular facing collar at one end presenting an annular facing surface dimensioned to journal around the spindle, and securing means for anchoring the tang of the spindle, wherein one bearing bushing of each pivot bearing is secured in a hole axially aligned with the pivot axis drilled into an inside surface of each side wall of the standing frame structure with the annular facing collar of the bushing facing in, and the other bearing bushing of each pivot bearing is secured in a hole axially aligned along a common axis drilled through each side member of the mattress frame near its head with the annular facing collar of the bushing facing out, and wherein the cylindrical spindle of each pivot bearing is received in a cylindrical passageway created by adjacent bearing bushings upon coaxially aligning the bearing bushings secured in the side frame members of the mattress frame with the pivot axis of the wall bed system for pivotally coupling the particular side frame members of the mattress pallet to the adjacent side wall of the standing frame structure with the annular facing collars of adjacent beating bushings in a facing relationship, the securing means anchoring the extending tangs of the respective spindles to the side members of the mattress frame.

2. An improved pivot bearing coupling between two articulating wood frame members comprising in combination, a cylindrical spindle having a tang at one end extending perpendicular to its axis, two cylindrical bearing bushings each having an annular facing collar at one end presenting an annular facing surface dimensioned to journal around the spindle, and securing means for anchoring the tang of the spindle, wherein each bearing bushing is secured in one wood frame member with annular facing collar seated on its surface, and wherein the cylindrical spindle is received in a common cylindrical passageway created upon coaxially aligning the bearing bushings with the annular facing collars in a facing relationship for pivotally coupling the respective wood frame members, the securing means anchoring the extending tang of the spindle to one of the wood frame members.

3. The improved pivot beating of claim 2 wherein one bearing bushing is secured in a hole drilled into a side of one of the wood frame member and the other bearing bushing is secured in a hole drilled completely through the other wood frame member, the spindle being inserted into the common cylindrical passageway defined by the adjacent bearing bushings via the hole drilled through that particular wood frame member, such that the pivot bearing coupling the respective articulating wood frame members is concealed with respect to surfaces opposite the side of the particular wood frame member having the hole drill into it.

4. The improved pivot bearing described in claim 1, or 2, or 3 wherein conical head screws secure the bearing bushings and anchor the tang of the spindle and wherein a countersunk hole is drilled perpendicularly through the respective annular facing collars of the bearing bushings and through the extending tang of the spindle for receiving the securing conical head screws.

5. The improved pivot beating of claim 4 wherein the respective countersunk hole drilled through the respective collars of the adjacent bearing bushings when secured to the respective frame members are rotationally oriented such that they do not coincide when the articulating wood frame members pivot relative to each other between selected positions.

6. The improved pivot bearing of claim 4 wherein the spindle and beating bushings are composed of hard wear resistant structural materials from a class consisting of steel alloys and iron alloys.

7. The improved pivot bearing of claim 4 and further including a Teflon impregnated liner lining the cylindrical bearing surfaces of the beating bushing receiving the distal end of the spindle.

8. The improved pivot bearing of claim 7 and further including a Teflon impregnated liner lining the facing surface of the annular facing collar of the beating bushing receiving the distal end of the spindle.

9. The improved pivot bearing of claim 4 wherein the bearing bushings are composed of wear resistant materials in a class consisting of acetyl homopolymer resins and acetyl copolymer resins and the spindle is composed of structural materials from a class consisting of alloys of iron, alloys of copper and alloys of aluminum.

10. The improved pivot bearing of claim 4 the bearing bushing receiving the distal end of the spindle is composed of wear resistant materials from a class consisting of acetyl homopolymer resins and acetyl copolymer resins, and the spindle and remaining bearing bushing is composed of structural materials from a class consisting of alloys of iron, alloys of copper and alloys of aluminum.

* * * * *